United States Patent [19]

Berry

[11] 4,395,230

[45] Jul. 26, 1983

[54] IGNITION CARRY-OVER IN MULTIPLE BURNER HEATING APPARATUS

[75] Inventor: Max A. Berry, Covina, Calif.

[73] Assignee: Abdul R. Ghafoori, Monterey Park, Calif.

[21] Appl. No.: 200,416

[22] Filed: Oct. 24, 1980

[51] Int. Cl.[3] ..... F23D 13/36

[52] U.S. Cl. ..... 431/286; 239/556

[58] Field of Search ..... 431/278, 283, 285, 286; 239/548, 556, 557, 555

[56] References Cited

U.S. PATENT DOCUMENTS

| | | | |
|---|---|---|---|
| 1,705,759 | 3/1929 | Glass | 431/283 |
| 2,443,101 | 6/1948 | Flynn et al. | 239/555 |
| 3,438,719 | 4/1969 | Gething | 431/286 |
| 3,578,891 | 5/1971 | Cavestany | 431/286 X |
| 3,694,133 | 9/1972 | Wilkerson | 431/286 X |

FOREIGN PATENT DOCUMENTS

| | | | |
|---|---|---|---|
| 2629988 | 1/1978 | Fed. Rep. of Germany | 239/557 |

*Primary Examiner*—Samuel Scott
*Assistant Examiner*—Margaret A. Focarino
*Attorney, Agent, or Firm*—Philip M. Hinderstein

[57] ABSTRACT

In a heating apparatus of the type including a multiplicity of spaced, independent burners arranged in a single plane between a pair of manifolds which conduct air and gas to the burners, there is disclosed an improved ignition carry-over wherein the burners are arranged in a non-parallel, zig-zag pattern with the first end of each burner spaced relatively closely to the first end of the adjacent burner on one side thereof and spaced relatively far from the first end of the adjacent burner on the other side thereof whereby the flame readily jumps from one burner to the next.

3 Claims, 1 Drawing Figure

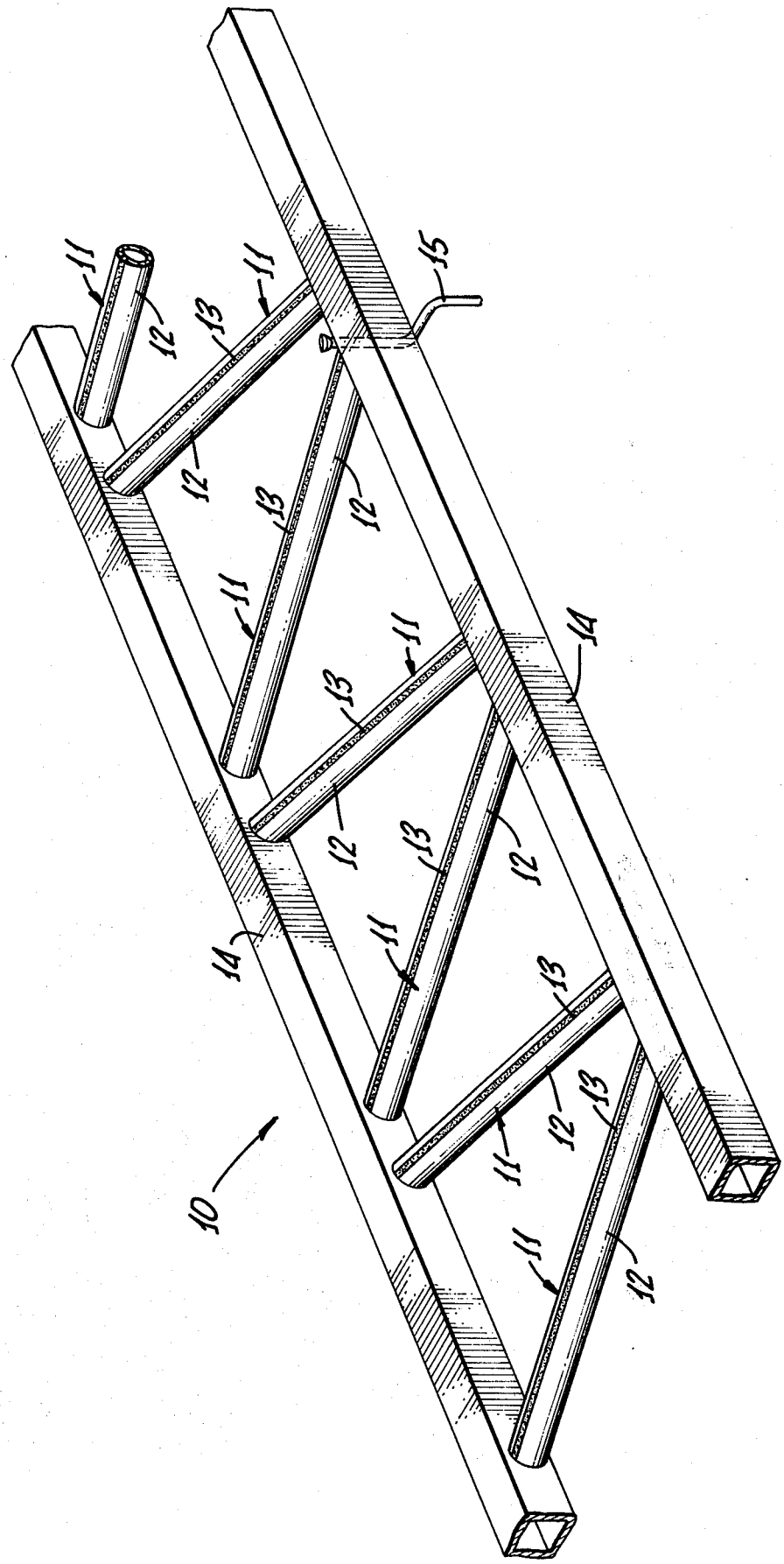
10
11
12
13
14
15

IGNITION CARRY-OVER IN MULTIPLE BURNER HEATING APPARATUS

BACKGROUND OF THE INVENTION

1. Field of the Invention

The present invention relates to ignition carry-over in multiple burner heating apparatus and, more particularly, to a simple and efficient method and means for effecting ignition, with a single pilot, or spark source, of all burners in a multiple burner heating apparatus.

2. Description of the Prior Art

A continuous oven typically consists of a conveyor belt which conducts a food product to be cooked through the oven. This conveyor belt is typically heated through the use of a multiplicity of spaced, independent burners situated in a single plane directly beneath the conveyor belt.

In heating apparatus of this type, the cost and complexity inherent in providing an individual firing mechanism for each of the several burners soon becomes prohibitive as the number of individual burners increases. Thus, it has become the common practice to provide a single pilot or spark source and means for firing all of the burners from such single source.

The most common technique utilized for igniting multiple burners from a single pilot or spark source is to position the burners in closely spaced, parallel relationship so that the flame will readily jump from one burner to the next. By spacing multiple, parallel burners no more than five inches apart, a flame will generally jump from one burner to the next without requiring separate ignition carry-over means. Unfortunately, this is not a very satisfactory solution to the problem because it means that a large number of parallel burners are necessary. Since the ends of the burners are typically connected to a manifold which conducts an air-gas mixture to the burners from a blower assembly, the large number of burners requires a blower having significant capacity and an excessive use of gas.

On the other hand, if the burners are spaced apart by more than five inches so as to minimize the number of burners and to minimize the blower capacity, the flame simply will not jump from one burner to the other. It therefore becomes necessary to put in a pilot runner or multiple ignition points, both of which cause extra maintenance problems. Alternatively, it becomes necessary to provide some kind of additional ignition carry-over means and many such ignition carry-over devices have been disclosed in the prior art. However, many of these known multiple burner firing arrangements are not totally reliable, are overly complex and interfere with the normal combustion process.

SUMMARY OF THE INVENTION

According to the present invention, these problems are solved by providing an elegantly simple, but highly effective, method of providing positive ignition in a heating apparatus of the type employing a multiplicity of spaced, independent burners. Following the teachings of the present invention, the number of burners can be reduced to the absolute minimum number required to heat the conveyor belt, thereby minimizing the blower capacity as well as the amount of gas used. This is achieved while still providing ignition from a single pilot or spark source and without the necessity for the unreliable, complex, ignition carry-overs used heretofore which interfere with the normal combustion process.

Briefly, in a heating apparatus of the type including a multiplicity of spaced, independent burners arranged in a single plane and at least one manifold connected to first ends of each of the burners for conducting air and gas thereto, the present invention comprises an improvement wherein the burners are arranged in a zig-zag pattern with the first end of each burner spaced relatively closely to the first end of the adjacent burner on one side thereof but spaced relatively far from the first end of the adjacent burner on the other side thereof whereby there is a spacing between each burner which is small enough to permit the flame to jump from one to another with a minimum number of burners and the need for only a single pilot or spark source.

OBJECTS, FEATURES AND ADVANTAGES

It is therefore an object of the present invention to solve the ignition problems in heating apparatus of the type employing a multiplicity of spaced, independent burners. It is a feature of the present invention to solve these problems by positioning the burners in a zig-zag pattern. An advantage to be derived is that a minimum number of burners are required. A still further advantage is the ability to minimize the blower capacity. A still further advantage is that gas usage is minimized. Another advantage is that all burners can be ignited from a single pilot or spark source. Still another advantage is that additional firing apparatus is not required. Still another advantage is that maintenance problems are reduced.

Still other objects, features, and attendant advantages of the present invention will become apparent to those skilled in the art from a reading of the following detailed description of the preferred embodiment constructed in accordance therewith, taken in conjunction with the accompanying drawing wherein:

BRIEF DESCRIPTION OF THE DRAWING

The sole FIGURE is a perspective view of a heating apparatus constructed in accordance with the teachings of the present invention.

DESCRIPTION OF THE PREFERRED EMBODIMENT

Referring now to the drawing, the present burner assembly, generally designated 10, is designed for use in a conventional cooking oven (not shown) of the type which uses a pre-mixed gas-air input source (not shown). Such a cooking oven typically includes a series of conveyor belts (not shown), often stacked one above the other, where a food product to be cooked is conveyed by the conveyor belts through the oven, often being deposited from the end of one conveyor belt onto the beginning of another conveyor belt positioned immediately therebelow. Cooking of the food product is done by the conveyor belt itself which is heated by a series of burners 11 which extend generally transversely underneath the conveyor belt and heat same.

As is known in the prior art, each burner 11 may be fabricated from a length of steel pipe 12 having welded therein a length of ribbon burner 13. The opposite ends of each length of pipe 12 are welded to manifolds 14 so that there is gas communication between manifolds 14 and each length of pipe 12. The ends of manifolds 14 are connected to another manifold (not shown) which is connected to a blower (not shown) which feeds a mixture of air and gas to manifolds 14 and burners 11.

It has been found that in order to adequately heat the conveyor belt extending across the top of burners 11, it is only necessary to space burners 11 by approximately eight inches. However, if burners 11 are positioned in parallel relationship, as is the case in the prior art, spacing burners 11 by eight inches will not permit the flame to jump from one burner 11 to the next. This being the case, it would be necessary to provide a separate ignition system for each burner 11 or to provide additional ignition carry-over means.

According to the present invention, the need for multiple pilot or spark sources is eliminated by placing burners 11 in a zig-zag pattern, as shown. According to a preferred embodiment of the present invention, the first end of each burner 11 is spaced by two inches from the first end of the adjacent burner 11 on one side thereof and by fourteen inches from the first end of the adjacent burner 11 on the other side thereof. This makes the average spacing between burners 11 eight inches. On the other hand, every burner 11 is, at one end, only two inches away from another burner 11. This being the case, a single pilot or spark source 15 may be positioned between the closely adjacent ends of two burners 11 to achieve ignition of all burners 11.

In operation, the air-gas mixture is blown into manifolds 14 where it is conducted to pipes 12 and ribbon burners 13. The first ends of ribbon burners 13 nearest pilot source 15 are ignited and the flame runs along their lengths. Because of the close proximity of the adjacent burners at their other ends, the flame jumps to these burners and then runs in a zig-zag pattern to the ends of each set of burners 11.

It can therefore be seen that according to the present invention, the ignition problems encountered heretofore in heating apparatus of the type employing a multiplicity of spaced, independent burners are solved. Furthermore, these problems are solved by providing an elegantly simple, but highly effective, method of providing positive ignition in this type of heating apparatus. Following the teachings of the present invention, the number of burners can be reduced to the absolute minimum number required to heat the conveyor belt, thereby minimizing the blower capacity. Furthermore, in use, it has been found that the amount of gas required can be substantially reduced. The objects of the present invention are achieved while still providing ignition from a single pilot or spark source without the necessity for the unreliable, complex ignition carry-over means used heretofore.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. In a heating apparatus of the type including a multiplicity of spaced, separate burners, each burner including an elongate length of pipe along which a flame extends, and at least one manifold connected to said burners for conducting air and gas thereto, the improvement wherein said burners are arranged in a zig-zag pattern with the first end of each burner spaced relatively closely to the first end of the adjacent burner on one side thereof and spaced relatively far from the first end of the adjacent burner on the other side thereof.

2. In a heating apparatus according to claim 1, the improvement wherein each burner includes a ribbon burner connected to said length of pipe.

3. In a heating apparatus according to claim 1 or 2, the improvement wherein both ends of said burners are connected to manifolds.

* * * * *